US009687972B2

(12) United States Patent
Sekino et al.

(10) Patent No.: US 9,687,972 B2
(45) Date of Patent: Jun. 27, 2017

(54) IMPACT ROTATION TOOL

(71) Applicant: PANASONIC CORPORATION, Osaka (JP)

(72) Inventors: Fumiaki Sekino, Osaka (JP); Toshiharu Ohashi, Shiga (JP); Tadashi Arimura, Kyoto (JP); Kenichirou Inagaki, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 763 days.

(21) Appl. No.: 14/048,228

(22) Filed: Oct. 8, 2013

(65) Prior Publication Data

US 2014/0102741 A1 Apr. 17, 2014

(30) Foreign Application Priority Data

Oct. 12, 2012 (JP) ..... 2012-227185

(51) Int. Cl.
*B25B 21/02* (2006.01)
*B25B 23/14* (2006.01)

(52) U.S. Cl.
CPC ..... *B25B 21/02* (2013.01); *B25B 23/1405* (2013.01)

(58) Field of Classification Search
CPC ..... B25B 21/02; B25B 21/00; B25B 21/026; B25B 21/008; B25B 23/1405; B25B 23/1475; B25B 23/1453; B25B 23/1456; B25B 23/14; B25B 23/142; B25B 23/1422; B25B 23/1425; B25D 11/068; Y10T 29/49766
See application file for complete search history.

(56) References Cited

U.S. PATENT DOCUMENTS 5,557,975 A * 9/1996 Crane ..... G01L 3/108 439/28
9,321,159 B2 * 4/2016 May ..... B23P 19/065
2005/0263304 A1 * 12/2005 Sainomoto ..... B25B 23/1405 173/2
2009/0139738 A1 * 6/2009 Lippek ..... B25B 23/14 173/181

(Continued)

FOREIGN PATENT DOCUMENTS

JP 1-106169 U 7/1989
JP 05-228850 A 9/1993

(Continued)

*Primary Examiner* — Thanh Truong
*Assistant Examiner* — Thomas Wittenschlaeger
(74) *Attorney, Agent, or Firm* — Renner, Otto, Boisselle & Sklar, LLP

(57) ABSTRACT

An impact rotation tool includes a drive source that generates power. An impact force generation unit generates impact force by changing the power generated by the drive source to pulsed torque. A shaft transmits the pulsed torque to the distal tool with the generated impact force. A torque detector generates a signal corresponding to the torque applied to the shaft. A determination unit determines whether or not a torque value obtained from a signal corresponding to the torque has reached a predetermined torque value. A control unit controls the drive source to a predetermined driving state when the determination unit determines that the torque value has reached the predetermined torque value. The determination unit is arranged on the shaft.

12 Claims, 8 Drawing Sheets

(56) References Cited

U.S. PATENT DOCUMENTS

| | | | | |
|---|---|---|---|---|
| 2010/0265097 | A1* | 10/2010 | Obatake | B25B 21/00 340/870.4 |
| 2011/0100170 | A1* | 5/2011 | Chiapuzzi | B25B 23/1425 81/479 |
| 2013/0153252 | A1* | 6/2013 | Sakakibara | B25B 21/008 173/1 |

FOREIGN PATENT DOCUMENTS

| | | | |
|---|---|---|---|
| JP | 08-267368 | A | 10/1996 |
| JP | 11-267981 | A | 10/1999 |
| JP | 2001-246574 | A | 9/2001 |
| JP | 2006-015438 | A | 1/2006 |
| JP | 2010-012587 | A | 1/2010 |
| JP | 2012-040629 | A | 3/2012 |

* cited by examiner

IMPACT ROTATION TOOL

CROSS-REFERENCE TO RELATED APPLICATIONS

This application is based upon and claims the benefit of priority from prior Japanese Patent Application No. 2012-227185, filed on Oct. 12, 2012, the entire contents of which are incorporated herein by reference.

BACKGROUND OF THE INVENTION

The present invention relates to an impact rotation tool including an impact force generation unit that converts the power of a drive source to impact force, which is pulsed torque, and uses the impact force to rotate a shaft, to which a tip tool is coupled.

An impact rotation tool decelerates the rotation output of a motor, which is one example of a drive source, with a deceleration mechanism, uses hydraulic pressure or the striking action of a hammer to convert the decelerated rotation output to pulsed impact torque, and performs a tightening task or a loosening task with the impact torque. Impact rotation tools are often used in construction sites and assembly factories (for example, refer to Japanese Laid-Open Utility Model No. 1-106169 and Japanese Laid-Open Patent Publication Nos. 1-106169, 8-267368, 2010-12587, and 11-267981).

When using an impact rotation tool, a fastener such as a bolt or screw, may be over-tightened by a large torque. On the other hand, when attempting to avoid such over-tightening, a fastener may be inefficiently tightened thus causing the fastener to be fixed with strength that is lower than necessary. Accordingly, Japanese Laid-Open Utility Model No. 1-106169 and Japanese Laid-Open Patent Publication No. 8-267368 each describe an impact rotation tool that measures torque with a strain gauge, a torque sensor, or the like, which is arranged on a shaft, so that a fastener can be tightened with a predetermined torque. When the torque indicated by the output value of the sensor reaches a predetermined torque such as a target torque, the motor is stopped.

In this case, the shaft on which the sensor is arranged is a drive portion. Thus, the sensor output value has a tendency of containing noise. This hinders accurate torque measurement. In particular, a relatively large noise is easily generated in an impact rotation tool when an impact force is applied to the shaft. As a result, in the sensor output, it is difficult to distinguish impact pulses from noise. As a result, when noise is erroneously detected as torque and the detected torque affected by noise reaches the predetermined torque, the motor may be controlled in a predetermined driving state and thereby be stopped. In such a case, the impact rotation tool stops before the tightening torque reaches the predetermined torque. To cope with this problem, Japanese Laid-Open Patent Publication No. 11-267981 describes an impact rotation tool that includes a filtering means such as low-pass filter to remove noise from the sensor output of a strain gauge, which is arranged on a drive shaft of a pulse wrench.

However, the filtering means of Japanese Laid-Open Patent Publication No. 11-267981 results in the impact rotation tool having a complicated structure. This increases the manufacturing cost of the impact rotation tool. It is difficult to set the cutoff frequency of the filtering means that distinguishes impact pulses from noise and removes only noise. For example, in an impact wrench, which is one type of an impact rotation tool, changes in the torque are more sudden than the pulse wrench of Japanese Laid-Open Patent Publication No. 11-267981. Thus, it is further difficult to distinguish impact pulses from noise.

SUMMARY OF THE INVENTION

One aspect of the present invention is an impact rotation tool including a drive source that generates power. An impact force generation unit generates impact force by changing the power generated by the drive source to pulsed torque. A shaft transmits the pulsed torque to the distal tool with the generated impact force. A torque detector generates a signal corresponding to the torque applied to the shaft. A determination unit determines whether or not a torque value obtained from a signal corresponding to the torque has reached a predetermined torque value. A control unit controls the drive source to a predetermined driving state when the determination unit determines that the torque value has reached the predetermined torque value. The determination unit is arranged on the shaft.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

First Embodiment

A first embodiment of an impact rotation tool will now be described with reference to FIGS. 1 to 6.

Figure 1:
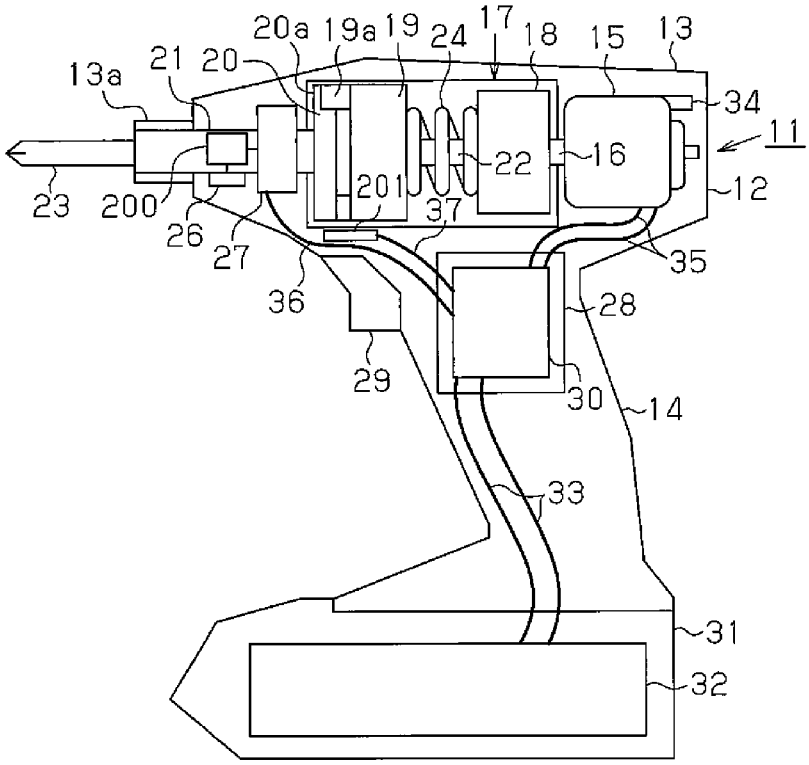
FIG. 1 is a schematic cross-sectional view showing a first embodiment of an impact rotation tool.

FIG. 1 shows an impact rotation tool 11 that is of a hand-held type and held by a single hand. The impact rotation tool 11 may be, for example, an impact driver or an impact wrench. A main body housing 12, which forms the casing of the impact rotation tool 11, includes a barrel 13 and a handle 14, which extends from the barrel 13. The handle 14 extends downward, as viewed in FIG. 1, in a direction intersecting the axis of the barrel 13.

A motor 15 is arranged in the barrel 13 at a basal side, which is the right side as viewed in FIG. 1. The axis of the motor 15 lies along the axis of the barrel 13. The motor 15 includes an output shaft 16 that faces toward a distal side of the barrel 13. The motor 15 is a DC motor and may be a brushed motor or a brushless motor. An impact force generation unit 17 is coupled to the output shaft 16 of the motor 15. The impact force generation unit 17 generates impact force by converting the rotation power produced by the motor 15 to pulsed torque.

The impact force generation unit 17 includes a deceleration mechanism 18, a hammer 19, an anvil 20, and a main shaft 21, which are sequentially arranged from the motor 15. The main shaft 21 is one example of a shaft. The deceleration mechanism 18 decelerates the rotation output of the motor 15 by a predetermined speed reduction ratio and increases the torque of the rotation. Then, the deceleration mechanism 18 transmits the decelerated and torque-increased rotation to the hammer 19, which strikes the anvil 20. The striking action of the hammer 19 applies the rotational force as an impact to the main shaft 21. The main shaft 21 may be formed integrally with the anvil 20 as a portion of the anvil 20. Alternately, the main shaft 21 may be formed discretely from the anvil 20 and be fixed to the anvil 20.

The hammer 19 is coupled to a drive shaft 22, which is rotated by the output of the deceleration mechanism 18. The hammer 19 is rotatable relative to the drive shaft 22 and movable toward the front and rear along the drive shaft 22. A coil spring 24 is arranged between the deceleration mechanism 18 and the hammer 19. The elastic force of the coil spring 24 urges the hammer 19 toward the front side, which is the left side as viewed in FIG. 1, to where the hammer 19 abuts against the anvil 20. Two abutment portions 19*a*, which extend from the hammer 19 toward the anvil 20, are arranged on the hammer 19 at equal intervals in the circumferential direction. Each abutment portion 19*a* abuts against an abutment portion 20*a*, which extends in the radial direction of the anvil 20. The abutment of the abutment portions 19*a* against the abutment portions 20*a* integrally rotate the hammer 19 and the anvil 20. This transmits the rotation of the drive shaft 22, decelerated by the deceleration mechanism 18, to the main shaft 21, which is coaxial with the anvil 20. The barrel 13 has a distal end, which is the right end as viewed in FIG. 1. A chuck 13*a* is arranged on the distal end of the barrel 13. The chuck 13*a* includes a socket that receives a distal tool 23. The distal tool 23 is removable from the chuck 13*a*.

When the rotation of the distal tool 23 tightens a fastener such as a bolt or a screw to a certain extent, the load applied to the main shaft 21 is larger than that applied, for example, when the tightening of the fastener starts. On the other hand, when the rotation of the distal tool 23 loosens a fastener to a certain extent, the load applied to the main shaft 21 is smaller than that applied, for example, when the loosening of the fastener starts. When a force larger than or equal to a predetermined level is applied between the hammer 19 and the anvil 20, the hammer 19 moves toward the rear, or rightward as viewed in FIG. 1, along the drive shaft 22 while compressing the coil spring 24. When the hammer 19 is rotated relative to the anvil 20 by a certain amount or greater, the compression force of the coil spring 24 is released. As a result, the urging force of the coil spring 24 causes the hammer 19 to strike the anvil 20 while rotating the hammer 19. Whenever the hammer 19 is rotated by a certain amount or greater relative to the anvil 20 by the load applied to the main shaft 21, the striking action of the hammer 19 is repeated. When the hammer 19 strikes the anvil 20 in this manner, an impact is applied to the fastener.

As shown in FIG. 1, a torque sensor 26, which is one example of a torque detector, and a rotation unit control circuit 200, are arranged on the main shaft 21 of the impact rotation tool 11. Further, a slip ring unit 27 is coupled to the main shaft 21 to transfer the output of the rotation unit control circuit 200 from the main shaft 21, which serves as a rotating system, to the wiring of the main body housing 12, which serves as a stationary system. The slip ring unit 27 is used for the output transfer between the main shaft 21 and the main body housing 12. This suppresses the twisting of wires and the entangling of wires to the main shaft 21.

The torque sensor 26 is a strain sensor capable of detecting torsional strain and adhered by an adhesive agent to the main shaft 21. The torque sensor 26 is connected to the rotation unit control circuit 200 to detect the strain produced in the main shaft 21 when torque is applied and generate a voltage signal that is proportional to the strain. The voltage signal generated by the torque sensor 26 is a torque detection signal corresponding to the torque, and the torque detection signal is provided from the torque sensor 26 to the rotation unit control circuit 200, which is arranged on the main shaft 21.

The rotation unit control circuit 200 receives the voltage signal from the torque sensor 26 and uses the received voltage signal to compute the torque acting on the main shaft 21 as a torque value. The rotation unit control circuit 200 generates a stopping signal in addition to the torque value, which is the computation result of the torque. The rotation unit control circuit 200 provides the torque value and the stopping signal via the slip ring unit 27 to a circuit substrate 28 of the main body housing 12. A main body control circuit 30, which controls the rotation and sets the torque for the motor 15, is arranged on the circuit substrate 28, which is arranged in the handle 14.

The main body housing 12 is a non-rotation portion that is not rotated by the rotation of the main shaft 21. An impact sensor 201 is coupled to the main body housing 12 in the vicinity of the hammer 19 to detect the impact produced by the hammer 19. An acceleration sensor that generates electric charge when stress is applied may be used as the impact sensor 201. Further, a microphone that detects the noise produced when the hammer 19 strikes the anvil 20 and generates a detection signal accordingly may be used as the impact sensor 201.

The handle 14 includes a trigger lever 29 operated by a user to drive the impact rotation tool 11. A battery pack holder 31, which is box-shaped, is attached in a removable manner to the lower end of the handle 14. The battery pack holder 31 accommodates a battery pack 32, which is a rechargeable battery. The impact rotation tool 11 is of a chargeable type that uses the battery pack 32 as a power source. The battery pack 32 is connected by power lines 33 to the main body control circuit 30.

A speed detector 34 is arranged on the motor 15 to detect the rotation speed of the motor 15. The speed detector 34 forms a rotation speed output unit and may be embodied in, for example, a frequency generator that generates a frequency signal having a frequency that is proportional to the rotation speed of the motor 15. The rotation speed detector 34 may be, for example, an encoder. When the motor 15 is of a brushless type, the speed detector 34 may be a Hall sensor, and the rotation speed may be obtained from the signal or back electromotive force of the Hall sensor. The speed detector 34 provides the main body control circuit 30 with a signal corresponding to the rotation speed.

Lead lines 35 electrically connect the main body control circuit 30 to the motor 15 to control and drive the motor 15. Further, signal lines 36 electrically connect the main body control circuit 30 to the rotation unit control circuit 200 via the slip ring unit 27. The signal lines 36 include four conductive lines, namely, a signal line that provides signals from the rotation unit control circuit 200 to the main body control circuit 30, a power line that supplies the rotation unit control circuit 200 with power, a signal line that provides the rotation unit control circuit 200 with a set torque value, and a ground line. FIG. 1 shows only one of the signal lines 36 to facilitate illustration. In this manner, the slip ring unit 27 is used to provide signals from the rotation unit control circuit 200 to the main body control circuit 30 and provide the set torque value from the main body control circuit 30 to the rotation unit control circuit 200. Further, a signal line 37 is connected to the main body control circuit 30 to provide a signal from the impact sensor 201 to the main body control circuit 30. A trigger switch, which is electrically connected to the main body control circuit 30, detects the operation of the trigger lever 29.

When the user is operating the trigger lever 29, the main body control circuit 30 executes a control for varying the rotation speed of the motor 15 in accordance with the pulled amount of the trigger lever 29. The main body control circuit 30 controls the amount of current flowing to the motor 15 with a motor driver to control the rotation produced by the motor 15 and set the torque of the motor 15. The rotation unit control circuit 200 receives a torque detection signal corresponding to the strain of the main shaft 21 detected by the torque sensor 26 and generates a stopping signal or the like when the computed torque value exceeds the set torque value.

The structure of the slip ring unit 27 will now be described with reference to FIGS. 2A and 2B.

Figure 2A:
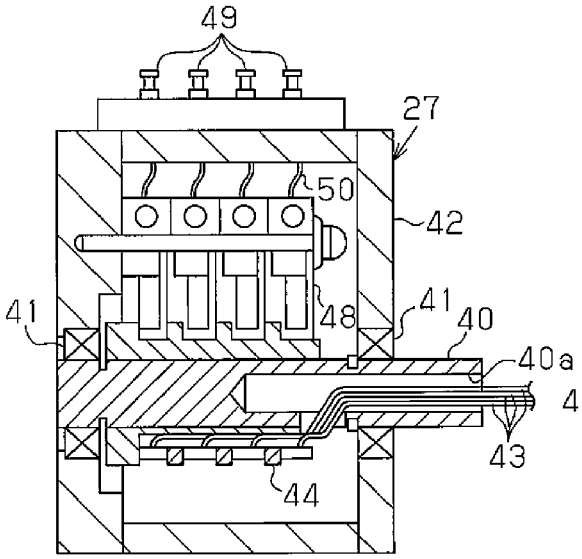
FIG. 2A is a cross-sectional view of a slip ring unit.
Figure 2B:
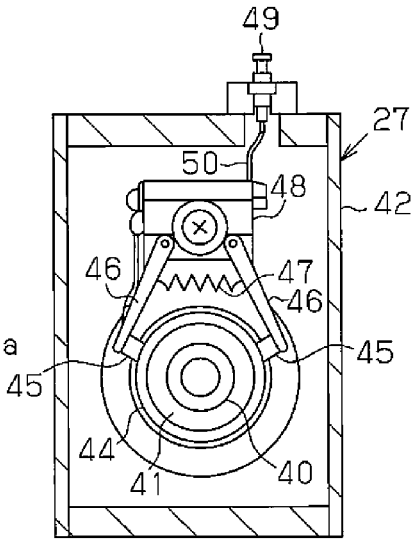
FIG. 2B is a front view of the slip ring unit.

As shown in FIGS. 2A and 2B, the slip ring unit 27 includes a case 42 provided with bearings 41 to rotatably support a rotation shaft 40, which forms the main shaft 21. Signal lines 43 extend from the torque sensor 26 via the rotation unit control circuit 200 toward the slip ring unit 27. The signal lines 43 extend through a wire conduit 40*a* and are connected to slip rings 44 in the case 42. For example, each of the four signal lines 43 extending from the torque sensor 26 is connected to a corresponding one of the slip rings 44. The case 42 includes four slip rings 44. The slip rings 44 are fixed to the outer surface of the rotation shaft 40.

As shown in FIG. 2B, the case 42 accommodates a terminal box 48 that pivotally supports basal portions of two arms 46. Each arm 46 includes a distal portion coupled to a brush 45. A spring 47 is coupled between the two arms 46 to urge the arms 46 toward each other. The urging force of the spring 47 forces the two brushes 45 against the outer surface of the corresponding slip ring 44.

The torque detection signal transmitted through each signal line 43 is provided to the terminal box 48 through a transmission line formed by the corresponding slip ring 44 and the corresponding pair of brushes 45. The signal provided to the terminal box 48 is sent to terminals 49, which are fixed to the outer upper side of the case 42, via signal lines 50. Each terminal 49 is connected to one of the signal lines 36 connected to the main body control circuit. The output of the rotation unit control circuit 200 is provided to the main body control circuit 30 as the slip rings 44 and the brushes 45 come into contact and move relative to each other in the slip ring unit 27. The set torque value provided from the main body control circuit 30 is provided to the rotation unit control circuit 200 as the slip rings 44 and the brushes 45 come into contact and move relative to each other in the slip ring unit 27.

The electrical configuration of the impact rotation tool 11 will now be discussed with reference to FIG. 3.

Figure 3:
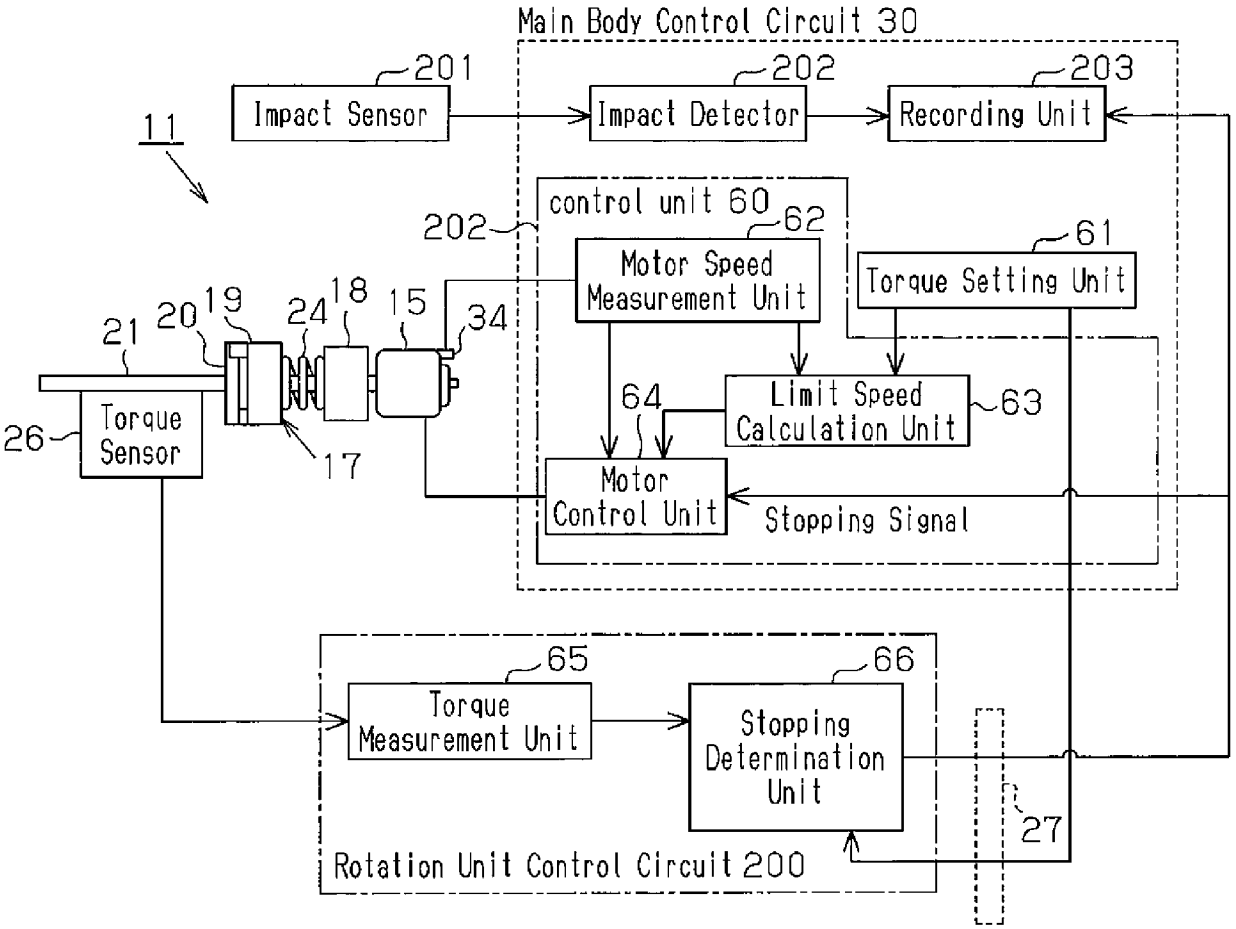
FIG. 3 is an electric block diagram of the impact rotation tool.

As shown in FIG. 3, the impact rotation tool 11 includes the torque sensor 26, the rotation unit control circuit 200, which receives a signal from the torque sensor 26, and the main body control circuit 30, which receives the output of the rotation unit control circuit 200 via the slip ring unit 27. The main body control circuit 30 includes a control unit 60, which manages torque and controls the speed of the motor 15, and a torque setting unit 61, which sets the set torque value used as a tightening torque target value. Further, the main body control circuit 30 includes a recording unit 203 that records the output of the rotation unit control circuit 200.

The torque setting unit 61, which is formed by, for example, a variable resistor or the like, is electrically connected to the control unit 60 and the rotation unit control circuit 200. The set torque for stopping the motor 15 is set when the user operates the torque setting unit 61. The torque setting unit 61 sets a target torque To within a range of ±10% of the set torque. The torque setting unit 61 may be configured to set the set torque as the target torque To. In the present embodiment, the target torque To corresponds to one example of a predetermined torque value.

The control unit 60 includes a motor speed measurement unit 62, which measures the rotation speed of the motor 15, the limit speed calculation unit 63, which calculates a limit speed, and a motor control unit 64, which drives and controls the motor 15. The main body control circuit 30 includes a CPU. The control unit 60 may be configured by software that has the CPU execute a control program to configure the units 62 to 64. Alternatively, the control unit 60 may be configured by hardware that forms the units 62 to 64 with integrated circuits such as ASICs. As another option, some of the units 62 to 64 may be configured by software, and the other units may be configured by hardware.

The motor speed measurement unit 62 measures the rotation speed of the motor 15 based on a signal corresponding to the speed provided from the speed detector 34. The limit speed calculation unit 63 receives the measured rotation speed of the motor 15 and the target torque To and calculates the limit rotation speed of the motor 15 when the trigger lever 29 is pulled in accordance with the level of the target torque To. The motor control unit 64 controls and drives the motor 15 so that the rotation speed of the motor 15 is limited to be less than or equal to the limit speed. When the target torque To is small, even if the trigger lever 29 is pulled by the maximum amount, the motor control unit 64 limits the motor 15 to a speed that is less than the maximum speed. The main body control circuit 30 also includes an impact detector 202 that receives a signal from the impact sensor 201, which detects impacts.

The rotation unit control circuit 200 includes a torque measurement unit 65, which measures the value of the torque applied to the main shaft 21 based on the detection signal of the torque sensor 26, and a stopping determination unit 66, which is one example of a determination unit that determines whether or not the torque value has reached the target torque. The torque measurement unit 65 obtains, for example, a peak value in the torque detection signal output from the torque sensor 26 as the torque value. The torque measurement unit 65 provides the obtained torque value to the stopping determination unit 66. The rotation unit control circuit 200 includes a CPU. The torque measurement unit 65 and the stopping determination unit 66 may be configured by software by having the CPU execute a torque detection program and a determination program. Alternatively, the torque measurement unit 65 and the stopping determination unit 66 may be configured by hardware including integrated circuits such as ASICs. As another option, one of the units 65 and 66 may be configured by software, and the other unit may be configured by hardware.

The operation of the impact rotation tool 11 in the present embodiment will now be described. For example, when a user tightens a bolt or a screw, the torque setting unit 61 is operated in advance to set the set torque. Then, when the user operates the trigger lever 29, the impact rotation tool 11 is driven. This rotates the distal tool 23 and tightens the bolt or screw.

When the impact rotation tool 11 is driven, the deceleration mechanism 18 decelerates the rotation output of the motor 15. This increases the torque of the rotation output. The rotation output is then transmitted via the impact force generation unit 17 to the main shaft 21 to rotate the distal tool 23 coupled to the distal end of the main shaft 21.

When a force that is larger than or equal to a predetermined level is produced between the hammer 19 and the anvil 20, the hammer 19 rotates relative to the anvil 20 and moves toward the rear along the drive shaft 22 against the urging force of the coil spring 24. This moves the hammer 19 away from the anvil. Then, due to the elastic force of the compressed coil spring 24, the hammer 19 strikes the anvil 20.

Figure 4:
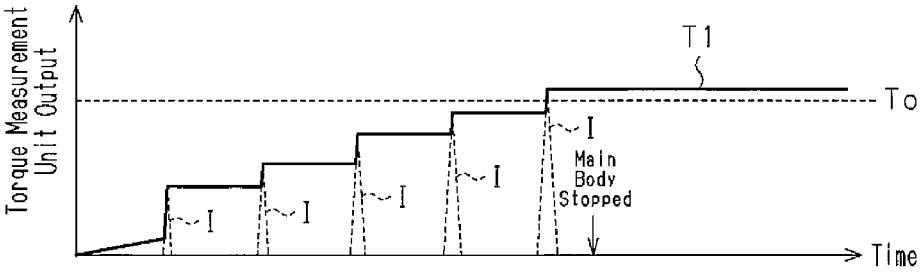
FIG. 4 is a graph showing the waveform of a voltage signal output from a torque measurement unit
Figure 5:
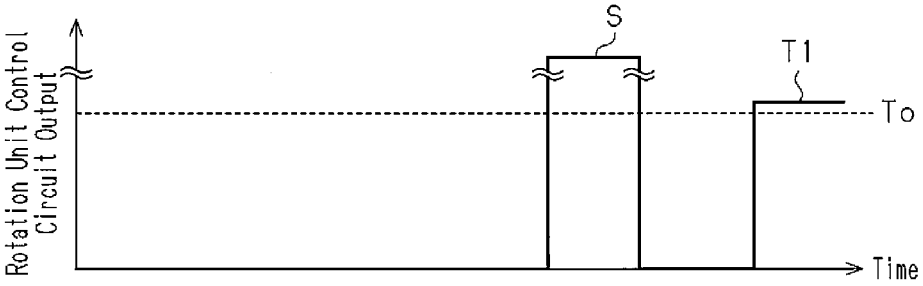
FIG. 5 is a graph showing the waveform of a voltage signal output from a rotation unit control circuit.
Figure 6:
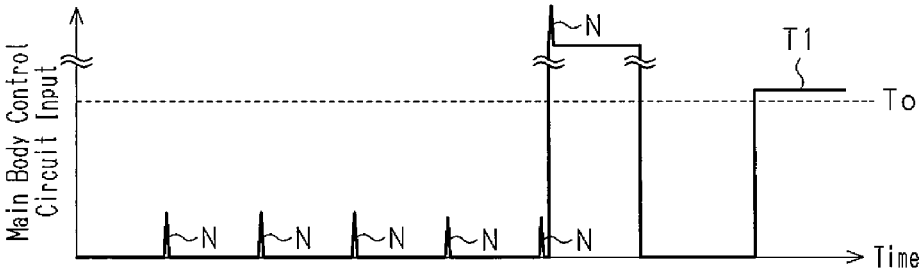
FIG. 6 is a graph showing the waveform of a voltage signal input to a main body control circuit and containing noise produced by an impact.

Referring to FIGS. 4 to 6, the determination process performed by the stopping determination unit 66 will now be discussed. A case in which the fastener tightened by the impact rotation tool 11 is a screw will be described. In FIG. 4, the solid line shows the torque value generated by the torque measurement unit 65, and the broken line shows the impact pulse formed for each impact in the waveform of the voltage signal generated by the torque sensor 26. FIG. 5 shows the waveform of the voltage signal generated by the rotation unit control circuit 200, and FIG. 6 shows the waveform of the voltage signal received by the main body control circuit 30.

As shown in FIG. 5, the hammer 19 does not strike the anvil 20 immediately after the impact rotation tool 11 starts tightening the screw. Thus, the torque value measured by the torque measurement unit 65 gradually increases as the screw tightens. When the torque exceeds a certain value and the hammer 19 strikes the anvil 20, the peak value in the output waveform of the torque sensor 26, that is, the peak value for each impact pulse I, is held as the torque value. The peak values of the impact pulse I gradually increase as the screw tightens. Thus, the torque value measured by the torque measurement unit 65 is updated in a stepped manner whenever an impact pulse I is generated.

Depending on the type of the impact rotation tool, the peak value in the waveform of the voltage signal generated by the torque sensor 26 may be difficult to detect, and the correlation may be low between the peak value in the waveform of the voltage signal and the actual torque. In such a case, the torque value may be estimated from a parameter having a greater correlation with the torque than the peak value such as the area of the waveform of the voltage signal generated by a single impact, that is, the area of a single impact pulse. The torque value may be estimated using a predetermined computation equation or a table prepared in advance.

When the torque value becomes torque value T1 and exceeds the target torque To, the stopping determination unit 66 provides the motor control unit 64 and the recording unit 203 with a stopping signal S that instructs the motor control unit 64 and the recording unit 203 to stop driving the motor 15. When the error between the target torque To and the torque value becomes less than or equal to a certain ratio even though the torque value does not exceed the target torque value, the stopping determination unit 66 provides the motor control unit 64 and the recording unit 203 with a stopping signal S that stops driving the motor 15. When the motor control unit 64 receives the stopping signal S from the stopping determination unit 66, the motor 15 stops operating. As a result, when the tightening torque reaches the target torque To, the impact rotation tool 11 stops operating.

The torque value measured by the torque measurement unit 65 as shown in FIG. 4 may be provided to the main body control circuit 30, which determines to stop the motor 15. In such a case, the torque measurement unit 65 provides the torque value to the main body control circuit 30 via the slip ring unit 27. Thus, when an impact pulse I is generated, the two brushes 45 of each slip ring unit 27 vibrate and produce noise N mixed in the output value of the slip ring unit 27. As a result, due the noise N generated from the slip ring unit 27, the difference between the target torque To and the output value of the slip ring unit 27 becomes greater than the difference between the target torque To and torque value of the torque measurement unit 65. This lowers the accuracy of the stopping determination.

In this regard, the present embodiment determines to stop the motor 15 with the rotation unit control circuit 200 arranged in the main shaft 21. Thus, the torque value that is free from the noise N from the slip ring unit 27 is compared with the target torque To. This increases the accuracy of the stopping determination for the motor 15.

Referring to FIG. 5, the rotation unit control circuit 200 of the present embodiment provides the main body control circuit 30 with a stopping signal S. The stopping signal S is an ON/OFF signal.

As shown in FIG. 6, when the stopping signal S is provided from the rotation unit control circuit 200 to the main body control circuit 30 via the slip ring unit 27, the signal output from the slip ring unit 27 includes noise. However, the noise N included in the signal output from the slip ring unit 27 is of a level that does not affect the input of the stopping signal S at the main body control circuit 30. Thus, when the stopping determination unit 66 generates the stopping signal S, that is, when the torque applied to the main shaft 21 reaches the target torque To, the motor 15 may be stopped.

After receiving the stopping signal S, the main body control circuit 30 may provide the stopping determination unit 66 with an instruction via a signal line to send the final torque value to the recording unit 203. In this case, the motor control unit 64 includes a rotation speed threshold set to obtain the final torque value, and compares the rotation speed provided from the motor speed measurement unit 62 with a threshold. When the rotation speed becomes equal to or less than a threshold, the motor control unit 64 provides the stopping determination unit 66 with an instruction to obtain the final torque value. The stopping determination unit 66 receives a command from the motor control unit 64 and provides the recording unit 203 with the final torque value T1 received from the torque measurement unit 65.

When the final torque value T1 is generated in this manner, the motor 15 and the output shaft 16 stop rotating. Thus, the output waveform provided from the rotation unit control circuit 200 via the slip ring unit 27 to the main body control circuit 30 does not include noise N produced when the hammer 19 strikes the anvil 20. Consequently, the recording unit 203 is provided with the torque value required for tightening that is more accurate than when the final torque value T1 is generated when the impact rotation tool 11 is operating, that is, when the motor 15 and the output shaft 16 is rotating. Whenever the user performs a tightening task, the recording unit 203 records the torque value and the time required for the tightening. This allows for the user to obtain the torque value and time for each task after the tasks are completed.

The impact rotation tool of the present embodiment has the advantages described below.

(1) The rotation unit control circuit 200, which includes the stopping determination unit 66, is arranged on the main shaft 21. Thus, the torque value compared to the target torque value does not include noise N produced from the slip ring unit 27. Consequently, the accuracy of the comparison result of the target torque value and the torque value is increased and the accuracy of the determination for stopping the motor 15 is increased as compared with a structure that arranges a control circuit including the stopping determination unit 66 in the main body housing 12. This reduces cases in which the motor 15 is controlled to a predetermined driving state before the torque reaches the predetermined torque due to erroneous torque detection caused by noise that is generated by an impact.

(2) When the motor 15 stops rotating, the rotation unit control circuit 200 provides the main body control circuit 30 with a final torque value after the output shaft 16 stops rotating. Thus, the main body control circuit 30 is provided with a further accurate final torque value compared to a structure that provides the main body control circuit 30 with the final torque value when the motor 15 and the output shaft 16 are still rotating.

(3) The slip ring unit 27 electrically connects the rotation unit control circuit 200 and the main body control circuit 30. Thus, the wires connecting the control circuit 200 and the main body control circuit 30 do not become twisted or entangled with the main shaft 21 during rotation of the main shaft 21.

Second Embodiment

A second embodiment of an impact rotation tool will now be described with reference to FIGS. 7 to 10. The impact rotation tool of the second embodiment differs from that of the first embodiment in how the output shaft 16 is rotated after the stopping signal S is provided from the stopping determination unit 66. The difference will now be described in detail.

As described above, the motor control unit 64 that receives the stopping signal S from the stopping determination unit 66 stops driving the motor 15. In this case, the hammer 19 may strike the anvil 20 until the output shaft 16 stops rotating. When the hammer 19 strikes the anvil 20 before the output shaft 16 stops rotating, the impact pulse I after the stopping determination unit 66 generates the stopping signal S may differ from the impact pulse I immediately before the stopping determination unit 66 generates the stopping signal S.

Figure 7:
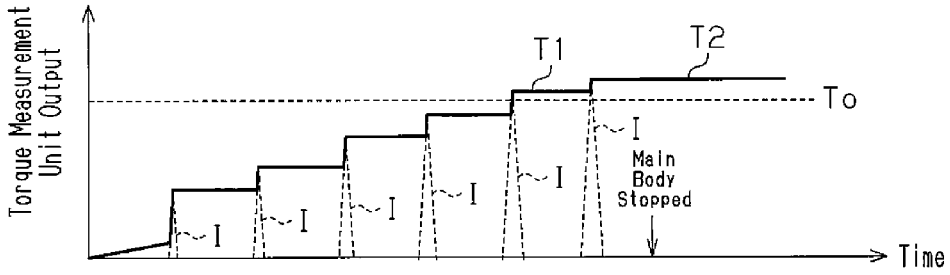
FIG. 7 is a graph showing the waveform of a voltage signal output from the torque measurement unit in a second embodiment when the torque is increased by an impact after a stopping signal is output.

Referring to FIG. 7, when the hammer 19 strikes the anvil 20 before the output shaft 16 stops rotating, the impact pulse I after the stopping determination unit 66 generates the stopping signal S may be larger than the impact pulse I immediately before the stopping determination unit 66 generates the stopping signal S. In such a case, the final torque value that is the torque value when the output shaft 16 of the motor 15 stops is varied from torque value T1 to torque value T2.

Figure 8:
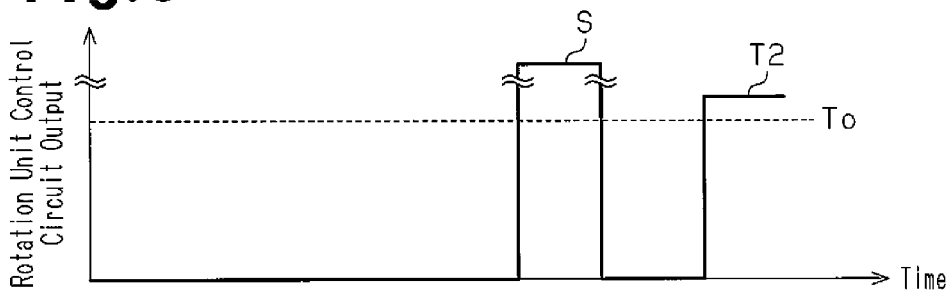
FIG. 8 is a graph showing the waveform of a voltage signal output from a rotation unit control circuit in the second embodiment when the torque is increased by an impact after a stopping signal is output.

Referring to FIG. 8, when the final torque value is varied from torque value T1 to torque value T2, the stopping determination unit 66 generates a stopping signal S. Then, the stopping determination unit 66 generates the torque value T2 as the final torque value T2 for when the motor 15 and the output shaft 16 stop rotating.

Figure 9:
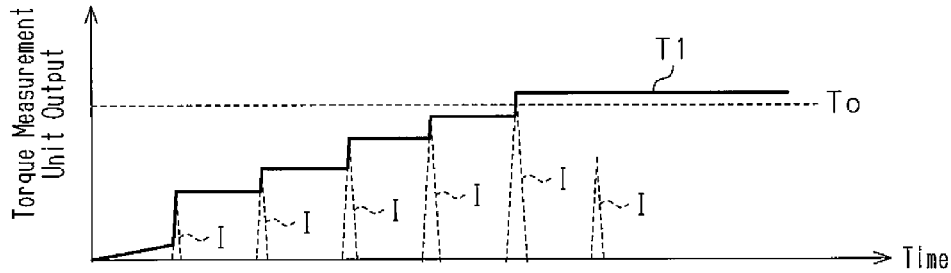
FIG. 9 is a graph showing the waveform of a voltage signal output from the torque measurement unit in the second embodiment when the torque is not increased by an impact after a stopping signal is output.

Referring to FIG. 9, when the hammer 19 strikes the anvil 20 before the output shaft 16 stops rotating, the impact pulse I after the stopping determination unit 66 generates the stopping signal S may be smaller than the impact pulse I immediately before the stopping determination unit 66 generates the stopping signal S. In such a case, the torque value before the output shaft 16 of the motor 15 stops is the maximum torque value measured by the torque measurement unit 65. Thus, the final torque value, which is the torque value when the output shaft 16 of the motor 15 stops, is held at the torque value T1.

Figure 10:
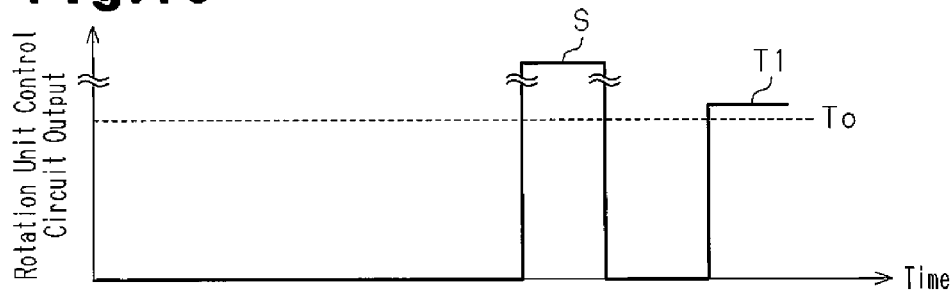
FIG. 10 is a graph showing the waveform of a voltage signal output from the rotation unit control circuit in the second embodiment when the torque is not increased by an impact after a stopping signal is output.

Referring to FIG. 10, when the final torque value is held as the torque value T1, the stopping determination unit 66 generates the stopping unit S. Then, the torque value T1 before the motor 15 and the output shaft 16 stop rotating is generated as the final torque value.

In this manner, in the present embodiment, the level of the impact pulse I after the stopping determination unit 66 generates the stopping signal S is compared with the torque value immediately before the stopping signal S is generated. The torque value is varied when the peak value of the impact pulse I is larger than the torque value immediately before the stopping signal S is generated. The torque value is maintained when the peak value of the impact pulse I is smaller than the torque value immediately before the stopping signal S is generated. In this manner, even when the impact pulse I is generated after the stopping signal S is generated, the final torque value provided from the stopping determination unit 66 is a torque value that reflects the impact pulse I. Thus, the accuracy of the final torque provided to the main body control circuit 30 may be increased.

In addition to the advantages of the impact rotation tool in the first embodiment, the impact rotation tool of the present embodiment has the following advantage.

(4) Even when an impact is produced after the stopping signal S is generated, the torque value before the stopping signal S is generated is compared with the peak value of the impact pulse I, and the comparison result is reflected to the final torque value. Thus, the final torque value is provided to the main body control circuit 30 with further accuracy.

Third Embodiment

A third embodiment of an impact rotation tool will now be described with reference to FIGS. 11 and 12. The impact rotation tool of the third embodiment differs from that of the first embodiment in that two slip ring units are arranged on the main shaft 21. The difference will now be described in detail.

Two slip ring units are arranged along the axial direction of the main shaft 21. The first slip ring unit is connected to the stopping determination unit 66 of the rotation unit control circuit 200. The stopping determination unit 66 provides the stopping signal S to the main body control circuit 30 via the first slip ring unit. The second slip ring is connected to the torque measurement unit 65 of the rotation unit control circuit 200. The torque measurement unit 65 provides the torque value to the main body control circuit 30 via the second slip ring unit.

Figure 11:
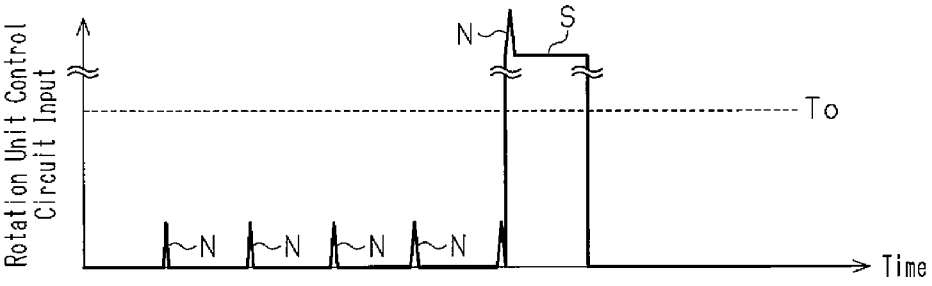
FIG. 11 is a graph showing the waveform of a voltage signal output from a rotation unit control circuit in a third embodiment.

Referring to FIG. 11, the stopping signal S from the stopping determination unit 66 is provided to the main body control circuit 30 via the first slip ring unit, and the output includes noise N from the first slip ring unit. The noise N produced from the first slip ring unit is of a level that does not affect the stopping signal S provided to the main body control circuit 30. Thus, the motor 15 may be stopped when the stopping determination unit 66 generates the stopping signal S, that is, when the torque applied to the main shaft 21 reaches the target torque To.

In this manner, the slip ring unit that provides the stopping signal S to the main body control circuit 30 differs from the slip ring unit that provides the torque value to the main body control circuit 30. Thus, the main body control circuit 30 is provided with the torque value even when provided with the stopping signal S. Thus, for example, the torque value is continuously provided to the main body control circuit from when the impact rotation tool 11 starts tightening a screw or the like to when the tightening is completed.

Figure 12:
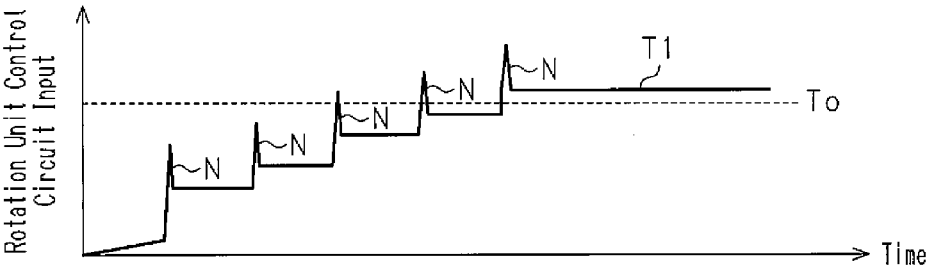
FIG. 12 is a graph showing the waveform of a voltage signal input to a main body control circuit when the noise produced by an impact is removed.

Referring to FIG. 12, the torque value provided to the main body control circuit 30 includes noise N produced from the second slip ring unit. Thus, although there is an error between the provide signal and the torque value measured by the torque measurement unit 65, the history of the torque value is recorded to the recording unit 203. As a result, in addition to the final torque value that is the torque value when the tightening ends, the torque value from when screw tightening starts to when the tightening ends is recorded to the recording unit 203 as a torque curve. This allows for the user to obtain information related to the torque from when the impact rotation tool 11 starts operating to when it stops operating.

In addition to the advantages of the impact rotation tool in the first embodiment, the impact rotation tool of the present embodiment has the following advantage.

(5) The stopping signal S from the stopping determination unit 66 and the torque value from the torque measurement unit 65 is provided to the main body control circuit 30 through different slip ring units. Thus, while increasing the accuracy of the determination for stopping the motor 15 with the stopping signal, torque information may be obtained from when a task starts to when the task ends.

Fourth Embodiment

A fourth embodiment of an impact rotation tool will now be described with reference to FIGS. 13 and 14. The impact rotation tool of the fourth embodiment differs from that of the third embodiment in that noise is eliminated from the torque value provided to the main body control circuit 30. The difference will now be described in detail.

As described above, the impact sensor 201 is arranged on the main body housing 12 of the impact rotation tool 11 to detect the impact of the hammer 19.

Figure 13:
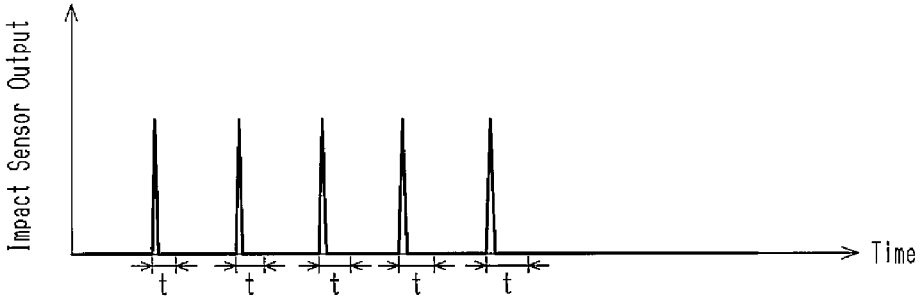
FIG. 13 is a graph showing the waveform of a voltage signal output from an impact sensor in a fourth embodiment.

Referring to FIG. 13, the impact sensor 201 generates an impact detection pulse as a predetermined voltage signal whenever detecting an impact. The impact sensor 201 generates an impact detection pulse when detecting, for example, stress that is greater than a predetermined value. As shown in FIG. 13, the impact sensor 201 may generate an impact detection pulse for a longer time when the impact is larger. Alternatively, the impact sensor 201 may generate an impact detection pulse for a fixed time regardless of the level of the impact.

The impact sensor 201 provides the impact detector 202 with an impact detection pulse. When the impact detector 202 receives the impact detection pulse, the impact detector 202 provides the main body control circuit with a prohibition signal that prohibits the updating of the torque value received via the second slip ring unit for a predetermined period t. As shown in FIG. 13, the impact detector 202 may be configured to set a longer predetermined period t as the output time of the impact detection pulse becomes longer. Alternatively, the impact detector 202 may be configured to set a fixed predetermined time t regardless of the output time of the impact detection pulse.

Figure 14:
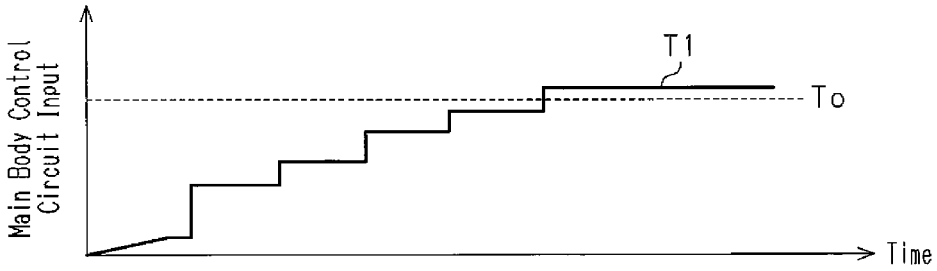
FIG. 14 is a graph showing the waveform of a voltage signal input to a main body control unit when the noise produced by an impact is removed.

As shown in FIG. 14, in the main body control circuit 30, the updating of the torque value provided via the second slip ring unit is prohibited during the predetermined period t. That is, the provided torque value is ignored. As a result, the second slip ring unit provides the main body control circuit 30 with a torque value from which noise is eliminated. In a configuration in which the main body control circuit 30 updates the torque value regardless of the produced impact, the torque value received by the main body control circuit 30 includes noise N as shown in FIG. 12.

In addition to the advantages of the impact rotation tool in the third embodiment, the impact rotation tool of the present embodiment has the following advantage.

(6) The main body control circuit 30 does not update the torque value until the predetermined period t elapses from when an impact is detected. This allows for the elimination of noise N from the torque value received by the main body control circuit 30.

Fifth Embodiment

A fifth embodiment of an impact rotation tool will now be described with reference to FIGS. 15 and 16. The impact rotation tool of the fifth embodiment differs from that of the first embodiment in that the torque value and the stopping signal S are simultaneously provided via the slip ring unit 27. The difference will now be described in detail.

In the present embodiment, the torque value provided to the stopping determination unit 66 from the torque measurement unit 65 is constantly provided to the main body control circuit 30 via the stopping determination unit 66 and the slip ring unit 27. Further, the stopping signal S generated by the stopping determination unit 66 is provided to the main body control circuit 30 via the slip ring unit 27.

Figure 15:
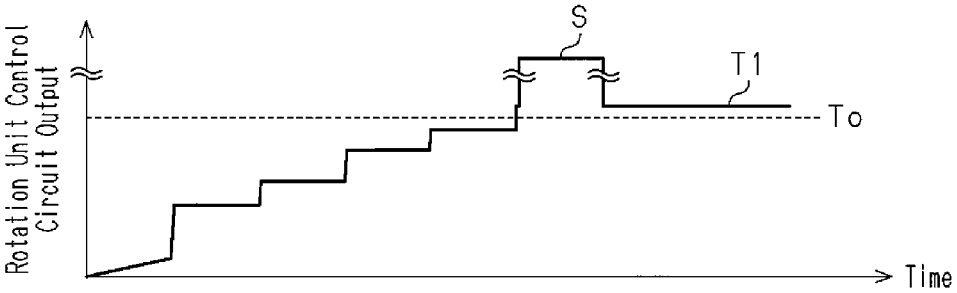
FIG. 15 is a graph showing the waveform of a voltage signal output from a rotation unit control circuit in a fifth embodiment.

Referring to FIG. 15, in the voltage signal generated by the rotation unit control circuit 200, the torque value and the stopping signal S are overlapped with each other.

Figure 16:
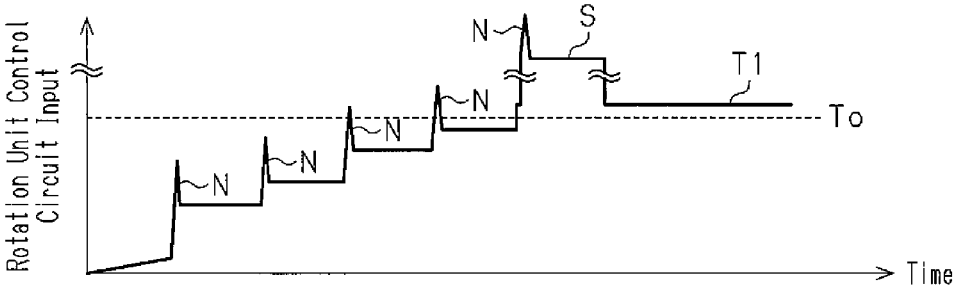
FIG. 16 is a graph showing the waveform of a voltage signal input to a main body control unit and containing noise produced by an impact.

Referring to FIG. 16, in the voltage signal received by the main body control circuit 30 via the slip ring unit 27, the torque value, the stopping signal S, and noise N resulting from impact are overlapped with one another.

When the voltage level of the stopping signal S rises, that is, when the stopping signal S has a logical value of "1," the voltage is set to be sufficiently larger than the maximum torque value expected for the impact rotation tool 11. Thus, even when the torque value and the stopping signal S are overlapped in the voltage signal received by the main body control circuit 30, the motor control unit 64 does not mistake the torque value as the stopping signal S.

In addition to the advantages of the impact rotation tool in the fifth embodiment, the impact rotation tool of the present embodiment has the following advantage.

(7) The output of the torque measurement unit 65 is continuously provided to the main body control circuit, and the output of the torque measurement unit 65 and the output of the stopping determination unit 66 are provided to the main body control circuit 30 via the single slip ring unit 27, namely, the four slip rings. Thus, without increasing the number of components forming the impact rotation tool 11, the torque value may be obtained from when a task starts to when the task ends while increasing the stopping determination accuracy for the motor 15.

Sixth Embodiment

Figure 17B:
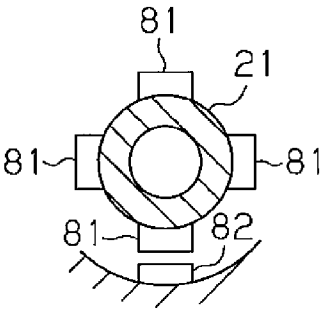
FIG. 17B is a cross-sectional view taken along line A-A in FIG. 17A.
Figure 17A:
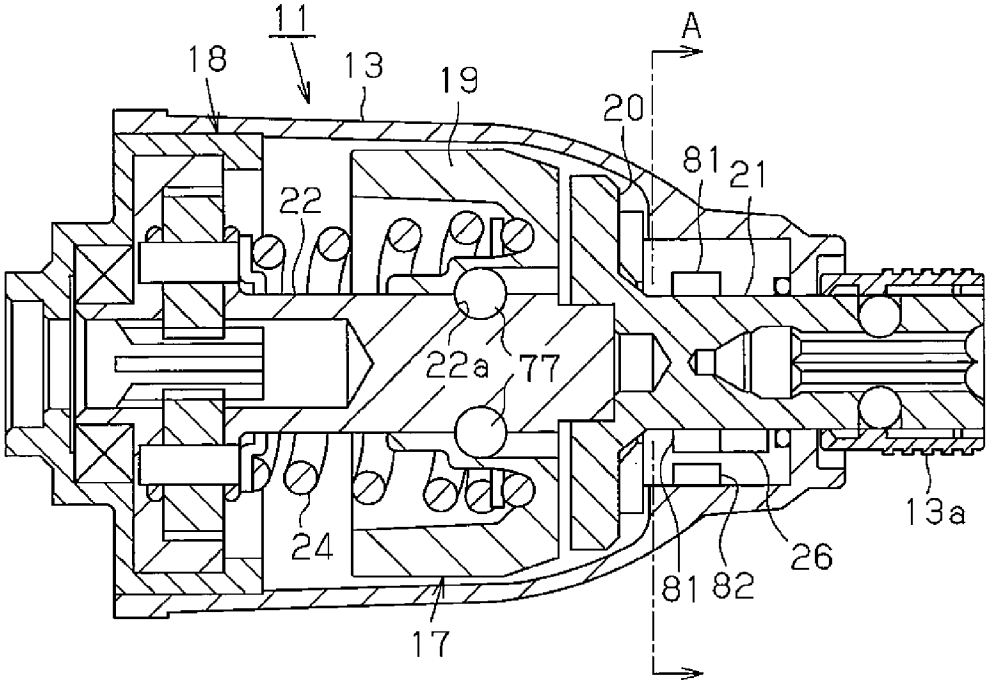
FIG. 17A is a partial cross-sectional view showing a sixth embodiment of an impact rotation tool.
Figure 18:
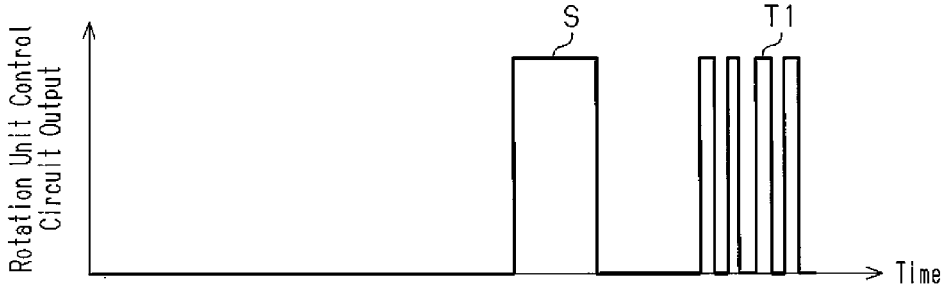
FIG. 18 is a graph showing the waveform of a voltage signal output from a rotation unit control circuit in the sixth embodiment.

Referring to FIGS. 17 and 18, a sixth embodiment of an impact rotation tool will now be described. The impact rotation tool of the sixth embodiment differs from that of the first embodiment in the mechanism that inputs and outputs signals between the rotating system and the stationary system. The difference will now be described in detail.

Referring to FIGS. 17A and 17B, the impact force generation unit 17 includes the deceleration mechanism 18, which is formed by a planetary gear mechanism, the hammer 19, and the anvil 20. The hammer 19 is supported by the drive shaft 22 urged toward the anvil 20 by the coil spring 24. The torque sensor 26, which is arranged on the main shaft 21, rotates together with the anvil 20 and the main shaft 21 and generates a signal corresponding to the torque applied to the main shaft 21.

When the motor 15 rotates the drive shaft 22, steel balls 77 rotate the hammer 19 integrally with the drive shaft 22. The anvil 20, which is in contact with the hammer 19, also rotates integrally with the drive shaft. When, for example, a screw is tightened, the load applied to the distal tool on the chuck 13*a* increases to an extent that the rotation of the distal tool cannot be maintained with the torque increased by the deceleration mechanism 18. This rotates the hammer 19 relative to the anvil 20, and moves the hammer 19 toward the rear, which is toward the deceleration mechanism 18, in the axial direction of the drive shaft 22 against the urging force of the coil spring 24 together with the steel balls 77. When the rearward movement of the hammer 19 separates the hammer 19 from the anvil 20, the coil spring moves the rotating hammer 19 toward the front and strikes the anvil 20 with the hammer. Rotation torque produced by the impact of the hammer 19 is applied to the main shaft 21.

A plurality of (for example, four) light transmission units 81 are arranged on the outer surface of the main shaft 21 at predetermined intervals in the circumferential direction. Each light transmission unit 81 is formed by, for example, a light-emitting diode. A light receiving unit 82 is arranged on the inner surface of the barrel 13 separated from the light transmission units 81. That is, the light receiving unit 82 is arranged on the inner surface of the barrel 13 so that the light receiving unit 82 may oppose any one of the light transmission units 81 in a non-contact state. In this manner, the light receiving unit 82 does not contact the light transmission units 81 and is arranged on a mounting portion that does not rotate with the drive shaft 22. The light receiving unit 82 is formed by, for example, a photodiode. Although four light transmission units 81 are arranged on the main shaft 21, the number of light transmission units 81 may be three or less or four or greater as long as light may be received from one of the light transmission units 81 regardless of the rotational angle of the main shaft 21.

The electrical configuration of the impact rotation tool 11 in the present embodiment is basically the same as that of the impact rotation tool in the first embodiment except for the light transmission units 81 and the light receiving unit 82.

More specifically, when a stopping signal, which is the output of the stopping determination unit 66 shown in FIG. 3, has a logical output of "1," the light transmission units 81 rotating integrally with the main shaft 21 are illuminated, and the light of the light transmission units 81 is received by the light receiving unit 82 as a stopping signal that is an instruction for stopping the operation of the motor 15. When the stopping signal, which is the output of the stopping determination unit 66, is "0," the light transmission units 81 are not illuminated. Thus, the light receiving unit 82 does not receive light.

In the present embodiment, under a non-contact state, the output from the stopping determination unit 66 is provided from the main shaft 21, which forms the rotating system, to the barrel 13, which forms the stationary system. Thus, in comparison to when a signal is provided from the stopping determination unit 66 in a contact state like the slip ring unit 27, noise resulting from an impact does not easily become contained in the output of the stopping determination unit 66.

Referring to FIG. 18, after the stopping signal S is provided from the rotation unit control circuit 200, the rotation of the motor 15 is stopped to stop rotating the main shaft 21 and the distal tool. Then, the torque value of the torque measurement unit 65 is provided from the rotation unit control circuit 200 to the main body control circuit 30 as a digital signal indicating a count value of pulses, that is, the final torque value T1. The final torque value T1 is then recorded to the recording unit 203.

In addition to the advantages of the impact rotation tool in the sixth embodiment, the impact rotation tool of the present embodiment has the following advantage.

(8) The stopping signal generated by the stopping determination unit 66 based on the signal of the torque sensor 26 may be transmitted in a non-contact state through optical communication from the light transmission units 81 to the light receiving unit 82. Thus, noise resulting from an impact does not easily become contained in the stopping signal. This increases the stopping determination accuracy for the motor 15.

It should be apparent to those skilled in the art that the present invention may be embodied in many other specific forms without departing from the spirit or scope of the invention. Particularly, it should be understood that the present invention may be embodied in the following forms.

In the main body control circuit 30, the signal line that provides the rotation unit control circuit 200 with a set torque value may be omitted. In this case, the set torque value is provided to the rotation unit control circuit 200 through the signal line that outputs signals from the rotation unit control circuit 200. This allows for the number of wire systems connected via the slip ring unit 27 to be decreased from four to three.

The stopping of the motor 15 and the output shaft 16 is determined by the rotation speed detector 34 that detects the rotation speed of the motor 15. Instead, for example, a rotation sensor may be arranged on a rotation shaft such as the main shaft 21 or the drive shaft 22, and the output of the rotation sensor may be used to determine the stopping of the motor 15 and the output shaft 16.

The rotation speed of the motor 15 after the stopping signal is generated does not have to be directly detected by the speed detector 34. For example, an estimation circuit may be used to estimate changes in the rotation speed of the motor 15 after the stopping signal is generated. When the rotation speed estimated by the estimation circuit is "0," it may be determined that the rotation of the motor 15 has stopped. That is, the rotation speed output unit that generates a signal corresponding to the rotation speed of the drive source may be a circuit that detects the rotation speed of the motor 15 and outputs the detection result. Alternatively, the rotation speed output unit may be a circuit that estimates the rotation speed of the motor 15 and outputs the estimation result.

As the rotation speed of the motor 15 decreases, the noise produced by an impact becomes smaller. When the rotation speed of the motor 15 is less than or equal to a threshold, the rotation unit control circuit 200 computes a final torque value, and a final torque value may be provided from the rotation unit control circuit 200 to the main body control circuit 30. In this configuration, the final torque value provided to the main body control circuit 30 becomes further accurate.

Instead of providing the final torque value after stopping the rotation of the motor 15 and the output shaft 16, the final torque value may be provided from the rotation unit control circuit 200 to the main body control circuit 30 after a predetermined period elapses from when the stopping signal is provided from the stopping determination unit 66.

In the embodiments other than the sixth embodiment, as shown in FIG. 18, the final torque value T1 provided from the control circuit 200 may be a digital signal indicated as a count value of a plurality of pulses. In this case, the torque measurement unit 65 may be formed by a processing circuit such as an A/D converter that converts the signal generated by the torque sensor 26 to a digital signal indicating a torque value and provides the torque value digital signal to the stopping determination unit 66.

The main body control circuit 30 is provided with the torque value of the torque measurement unit 65. However, a signal corresponding to the torque provided from the torque sensor 26 may be provided to the main body control circuit 30.

The member on which the torque sensor 26 is arranged is not limited to the main shaft 21 and may be a member that allows for the torque sensor 26 to detect the torque applied to the main shaft 21, such as the drive shaft 22, the anvil 20, and the hammer 19.

In the impact rotation tools 11 of the second embodiment and the fifth embodiment, the output of the torque value from the rotation unit control circuit 200 does not have to be constantly performed and may be intermittently performed.

In the first embodiment, the predetermined driving state of the motor 15, which is the drive source, is the stopped state but may be a decelerated state that reduces the rotation speed of the motor 15. In this case, for example, a deceleration initiation torque value is set to be smaller than the target torque To by a predetermined value, and a control for decelerating the rotation of the motor 15 may be performed when the torque value reaches the deceleration initiation torque value. Further, a control for stopping the motor 15 may be performed after the motor 15 is driven in the decelerated state for a predetermined period. The predetermined driving state of the motor 15 may also be an accelerated state that increases the rotation speed of the motor 15. In this case, to additionally tighten a screw or the like, when the torque value reaches a predetermined torque value, the motor 15 may be accelerated to a higher rotation speed until the main shaft 21 is rotated by a predetermined rotation amount or until the torque value reaches an additional tightening target torque value.

The third and fourth embodiments use two slip ring units. Instead of using two slip ring units in the third and fourth embodiments, the single slip ring unit 27 of the first embodiment may include an additional slip ring, that is, a total of five slip rings. By connecting the stopping determination unit 66 and the torque measurement unit 65 to different slip rings, the stopping signal and the torque value may be separately provided. This obtains the same advantages as the third and fourth embodiments.

Figure 19A:
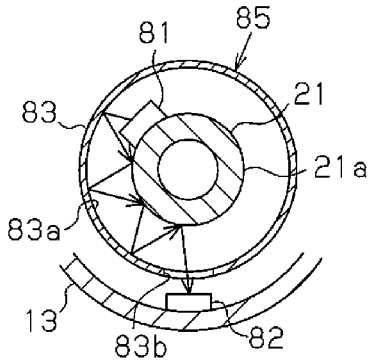
FIGS. 19A and 19B are schematic cross-sectional views showing modifications of a light transmission unit.
Figure 19B:
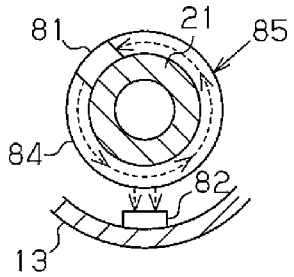

As shown in FIGS. 19A and 19B, in the sixth embodiment, a light transfer unit 85 that transmits light from a light transmission unit 81 to the light receiving unit 82 may be arranged at the outer side of the main shaft 21. In the example of FIG. 19, even though there is only one light transmission unit 81, the light transfer unit 85 allows for the light from the light transmission unit 81 to be received by the light receiving unit 82. The light transfer unit 85 may be of a reflective type as shown in FIG. 19A or a light guide type as shown in FIG. 19B.

In the light transfer unit 85 of the reflective type shown in FIG. 19A, for example, a metal tube 83 is arranged around the main shaft 21 without contacting the main shaft 21 and the light transmission unit 81. The metal tube 83 is concentric with the main shaft 21. The tube 83 includes an inner surface defining a mirror surface 83*a*, and the main shaft 21 includes an outer surface defining a mirror surface 21*a*. The tube 83 includes a light emission hole 83*b* at a position opposing the light receiving unit 82. The light from the light transmission unit 81 is, for example, alternatively reflected by the mirror surface 83*a* and the mirror surface 21*a* and advanced in the circumferential direction between the main shaft 21 and the tube 83. Then, the light is emitted from the light emission hole 83*b* and received by the light receiving unit 82.

In the light transfer unit 85 of the light guide type shown in FIG. 19B, the single light transmission unit 81 is arranged on the outer surface of the main shaft 21 so that the light is emitted from the light transmission unit 81 in a sideward direction that is the tangential direction of the outer surface of the main shaft 21. Further, a tubular light guide plate 84 is arranged on the main shaft 21 concentric with the main shaft 21. A circumferential end of the light guide plate 84 is opposed to the light emission portion of the light transmission unit 81, and the light guide plate 84 is in contact with the outer surface of the main shaft 21. Further, the light emitted from the light transmission unit 81 is propagated in the circumferential direction in the tubular light guide plate 84. This illuminates the entire outer surface of the light guide plate with light having a predetermined brightness or greater, and the light of the light guide plate 84 is received by the light receiving unit.

In these structures, the light from the single light transmission unit 81 may be received by the light receiving unit 82. Thus, in comparison with the structure of the sixth embodiment, the light transfer unit 85 is added. However, three light transmission units 81 and light emission control wires may be omitted in the example shown in FIG. 17. This simplifies the structure and reduces the power consumption of the light transmission unit 81.

The motor may be a DC motor or AC motor other than a brushed motor or brushless motor.

The drive source of the impact rotation tool 11 is not limited to a motor and may be, for example, a solenoid. Further, the drive source does not have to be an electric drive source like a motor or a solenoid and may be a hydraulic drive source. In this case, the drive source may be, for example, a hydraulic motor of which output rotation is provided to the impact force generation unit 17. Alternatively, the drive source may be a hydraulic cylinder, and pulsed impact force may be generated with the hydraulic force of the impact force generation unit 17. Further, the drive source may be of a pneumatic type.

The impact rotation tool 11 may be an AC impact rotation tool that is non-chargeable.

In addition to an impact driver and an impact wrench, the impact rotation tool 11 may be a hammer drill, a circular saw, a jigsaw, a vibration driver, a grinder, a nail gun, or the like. In these cases, an impact force generation unit is used to generate an impact force and rotate a shaft when a large load is applied to the shaft.

The present examples and embodiments are to be considered as illustrative and not restrictive, and the invention is not to be limited to the details given herein, but may be modified within the scope and equivalence of the appended claims.

The invention claimed is:

1. An impact rotation tool comprising:

a drive source that generates power;

an impact force generation unit that generates impact force by changing the power generated by the drive source to pulsed torque;

a shaft that transmits the pulsed torque to a distal tool with the generated impact force;

a torque detector that generates a signal corresponding to the torque applied to the shaft;

a determination unit that determines whether or not a torque value obtained from a signal corresponding to the torque has reached a predetermined torque value; and a control unit that controls the drive source to a predetermined driving state when the determination unit determines that the torque value has reached the predetermined torque value, wherein a rotation unit control circuit including the determination unit is arranged on the shaft, and the impact rotation tool further comprising a slip ring unit arranged between the torque detector and the control unit, wherein the slip ring unit transmits a signal from the torque detector to the control unit.

2. The impact rotation tool according to claim 1, further comprising:

a rotation speed output unit that generates a signal corresponding to a rotation speed of the drive source; and a torque measurement unit that obtains the torque value from the signal corresponding to the torque, wherein the determination unit provides the control unit with the torque value obtained by the torque measurement unit when determining that the rotation speed is less than or equal to a threshold based on the signal corresponding to the rotation speed of the drive source generated by the rotation speed output unit.

3. The impact rotation tool according to claim 2, wherein the determination unit constantly continues to provide the control unit with the torque value obtained by the torque measurement unit.

4. The impact rotation tool according to claim 3, wherein the control unit ignores the torque value obtained by the torque measurement unit from when the impact force is generated to when a predetermined period elapses.

5. The impact rotation tool according to claim 2, wherein the torque measurement unit constantly continues to provide the control unit with the signal corresponding to the torque.

6. The impact rotation tool according to claim 2, wherein the determination unit generates a stopping signal when determining that the torque value has reached the predetermined torque value, and the determination unit provides the control unit with the stopping signal and the torque value, which is obtained from the torque measurement unit, using the same signal line.

7. The impact rotation tool according to claim 1, wherein when the impact force generation unit generates the impact force after the determination unit determines that the torque value has reached the predetermined torque value, the determination unit provides the control unit with a torque value based on a comparison of the impact force generated before the determination and the impact force generated after the determination.

8. The impact rotation tool according to claim 7, wherein when the impact force generated before the determination is greater than the impact force generated after the determination, the determination unit provides the control unit with a torque value taken before the determination, and when the impact force generated before the determination is less than the impact force generated after the determination, the determination unit provides the control unit with a torque value taken after the determination.

9. The impact rotation tool according to claim 1, wherein the slip ring unit is arranged on a portion of the shaft between the impact force generation unit and the torque detector.

10. The impact rotation tool according to claim 1, wherein the slip ring unit is arranged between the determination unit and the control unit, wherein the slip ring unit transmits a signal from the determination unit to the control unit.

11. The impact rotation tool according to claim 10, wherein the slip ring unit is arranged on a portion of the shaft between the impact force generation unit and the determination unit.

12. The impact rotation tool according to claim 1, further comprising:

a light transmission unit that rotates integrally with the shaft and generates light corresponding to a signal provided from the determination unit;

a light receiving unit that receives light from the light transmission unit; and a mounting portion on which the light receiving unit is mounted, wherein the mounting portion does not contact the light transmission unit and is not rotated by rotation of the shaft.

* * * * *